US006055685A

United States Patent [19]

Norton et al.

[11] Patent Number: 6,055,685

[45] Date of Patent: May 2, 2000

[54] APPARATUS FOR BATHING A DISABLED PATIENT

[76] Inventors: Joseph P. Norton; Patricia A. Norton, both of 1319 Highbridge Rd., Cuyahoga Falls, Ohio 44223

[21] Appl. No.: 09/128,914

[22] Filed: Aug. 4, 1998

[51] Int. Cl.[7] ..... A47K 3/02

[52] U.S. Cl. ..... 4/565.1; 4/560.1; 4/592

[58] Field of Search ..... 4/560.1, 561.1, 4/562.1, 563.1, 564.1, 565.1, 566.1, 578.1, 579, 573.1, 584, 592

[56] References Cited

U.S. PATENT DOCUMENTS

| | | | |
|---|---|---|---|
| 2,604,638 | 7/1952 | Furry | 4/565.1 |
| 2,624,053 | 1/1953 | Beckwith | 4/565.1 |
| 2,788,527 | 4/1957 | Steven | 4/565.1 |
| 3,246,346 | 4/1966 | Schmidt . | |
| 3,581,316 | 6/1971 | Petersen | 4/566.1 |
| 4,034,424 | 7/1977 | Budlong . | |
| 4,305,165 | 12/1981 | Wall, Jr. . | |

FOREIGN PATENT DOCUMENTS

| | | | |
|---|---|---|---|
| 2202437 | 9/1988 | United Kingdom | 4/565.1 |

*Primary Examiner*—Robert M. Fetsuga
*Attorney, Agent, or Firm*—Oldham & Oldham Co. LPA

[57] ABSTRACT

Apparatus for bathing a disabled patient, comprising (a) a bathtub, (b) a flexible membrane positioned above the tub for lowering the patient into and lifting the patient from the tub, (c) membrane engaging members for engaging opposite ends of the membrane, one of the membrane engaging members including a rotatable driven shaft which is rotated in a first direction to raise the membrane and a patient therein and in a second direction to lower the membrane and a patient thereon, and (d) a drive mechanism for rotating the driven shaft in order to raise of lower the membrane and patient thereon. The preferred membrane is a woven nylon cloth.

15 Claims, 6 Drawing Sheets

APPARATUS FOR BATHING A DISABLED PATIENT

BACKGROUND OF THE INVENTION

1. Field of the Invention

This invention relates to an apparatus for bathing a disabled person.

2. Description of the Prior Art

A conventional bathtub can be used only with great difficulty, if at all, by a person who lacks mobility, because the person cannot lower himself or herself to the bottom of a bathtub, or raise himself or herself and climb out of the tub when the bath is finished.

Various apparatus for use by disabled persons and bed patients, i.e., persons who have suffered either temporary or permanent loss of mobility, are known.

One such apparatus shown in U.S. Pat. No. 3,246,346 permits a bedridden patient to be bathed at the patient's bed. Such apparatus must be emptied and taken away after each use. This apparatus is inconvenient.

Another apparatus, shown in U.S. Pat. No. 4,034,424, provides an auxiliary bathtub which includes a frame and a waterproof liner which forms a water tight container. At least one side wall of the apparatus pivots downwardly to allow entry into and exit from the tub. The apparatus is supported above a conventional bathtub and is taken away after use. Such apparatus is inconvenient. It is also better suited to a patient having limited mobility than to a patient having no mobility at all.

Although various apparatus for bathing a disabled person are known, none has achieved widespread use. An apparatus which is convenient to use and which makes it possible to bathe an immobile person thoroughly and to avoid heavy lifting of a patient by a person who assists in bathing the patient, is needed. No such apparatus is known at present.

SUMMARY OF THE INVENTION

An object of this invention is to provide an apparatus which is capable of lowering a disabled patient into a bathtub for bathing, and lifting the patient up to the uppermost level or rim of the bathtub when bathing is completed, without heavy lifting by a person who is bathing or assisting a patient.

This invention provides an apparatus for bathing a disabled patient, which comprises:

an open top tub for receiving a disabled patient for bathing, and a flexible membrane or sheet capable of lowering the patient into the tub and lifting the patient from the tub.

The apparatus of this invention further comprises first and second membrane engaging members, which are spaced apart for engaging opposite first and second ends of the membrane or sheet. The first membrane engaging member is a driven shaft around which a first end portion of the sheet is wound. This shaft is capable of rotation in opposite first and second directions. Rotation in a first direction causes the sheet to be wound and raised. Rotation in a second direction causes the sheet to be unwound and lowered. When a patient is supported on the membrane or sheet, rotation of the shaft in the first direction raises the patient, and rotation in the second direction lowers the patient into the tub.

The second membrane engaging member may be a part which clamps the second end of the membrane and holds it in place.

Finally, this invention comprises a drive mechanism for rotating the driven shaft and thereby raising and lowering the sheet or membrane. This drive mechanism is preferably a motor drive mechanism.

This invention also provides a method for bathing a disabled patient. This method comprises: providing an apparatus as above described; filling the bathtub with water; placing the patient on the membrane while the membrane is in a raised position above the level of water in the bathtub; lowering the membrane and the patient thereon into the bathtub; bathing the patient; and raising the membrane and the patient thereon to the raised position when bathing is finished.

DESCRIPTION OF THE PREFERRED EMBODIMENTS

Figure 1:
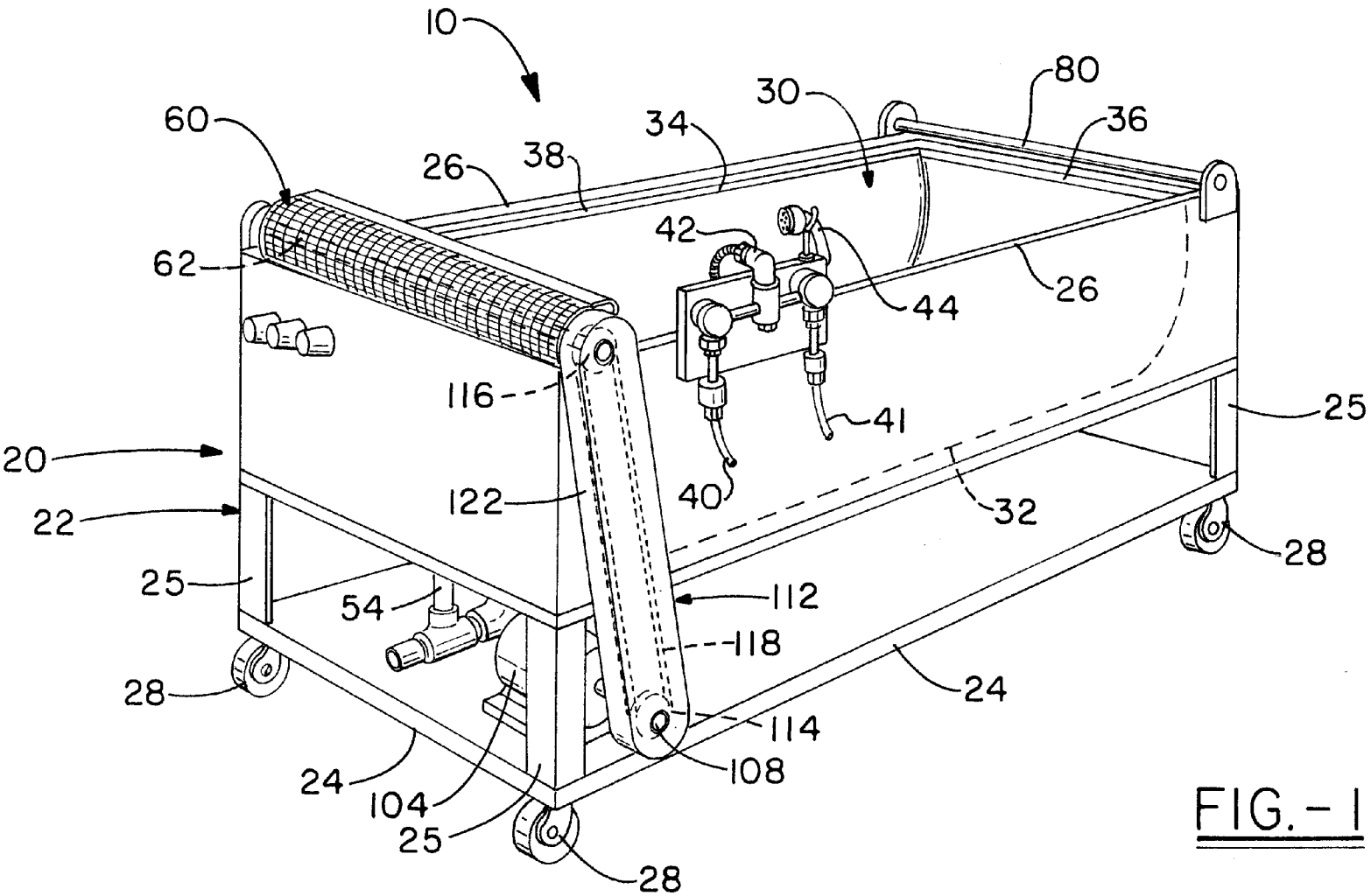
FIG. 1 is a perspective view of the apparatus of this invention as seen from the front and to the left of the apparatus, with a flexible membrane for supporting a patient shown rolled up at one end of the apparatus.

This invention will be described in detail with respect to the best mode and preferred embodiment thereof.

Referring to the drawings and especially to FIGS. 1, 2, 3 and 4, 10 is an apparatus according to this invention. This apparatus is particularly useful for bathing a disabled patient. The patient may be one who has no use of his or her arms or legs, and the description herein will relate the present invention particularly to the needs of such a patient. However, the present apparatus is also useful for bathing a patient having a lesser degree of impairment, as for example a patient who is paralyzed from the waist down, or a patient who has some use of his or her legs but who can climb into and out of a bathtub only with difficulty.

The preferred apparatus 10 of this invention comprises a longitudinally extending cart 20 having a frame 22. The frame 22 may comprise horizontal frame members 24, which may include two spaced horizontal and parallel longitudinally extending side members and two spaced horizontal and parallel transversely extending end members which together form a first rectangle a short distance above floor level. Like any rectangle, this rectangle has four corners. These frame members may be angle irons of L-shaped cross section. The frame 22 may also include vertical frame members 25, which may comprise vertical angle irons or L-shaped cross section extending upwardly at the four corners of the rectangle. Frame 22 may include a second set of horizontal frame members forming a second rectangle, which may be about midway between the upper and lower ends of vertical frame members 25.

The vertical angle irons or frame members of frame 22 may extend upwardly and terminate at a uniform height which is convenient for the upper end of a bathtub. Frame 22 further includes a horizontal rectangular rim 26 at the upper end thereof. Rim 26 joins the upper ends of the vertical frame members.

The apparatus 10 may be movably supported by means of four casters 28, which are secured to the frame 22 at the four corners thereof. It is desirable to provide these casters with floor locks.

Figure 3:
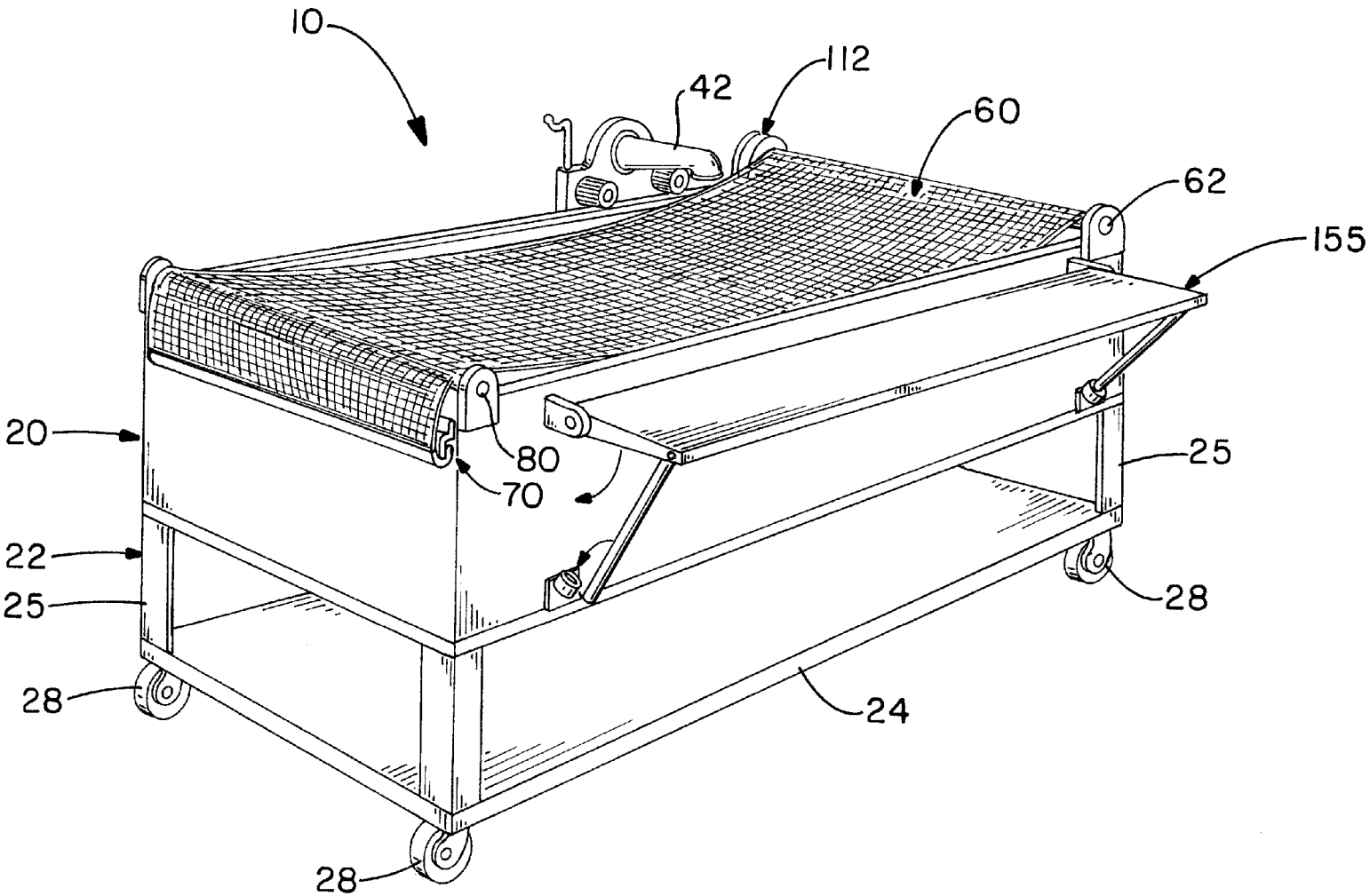
FIG. 3 is a perspective view of the apparatus as seen from behind and to one side, looking toward the side opposite that shown in FIGS. 1 and 2, with the flexible membrane in a raised position.
Figure 4:
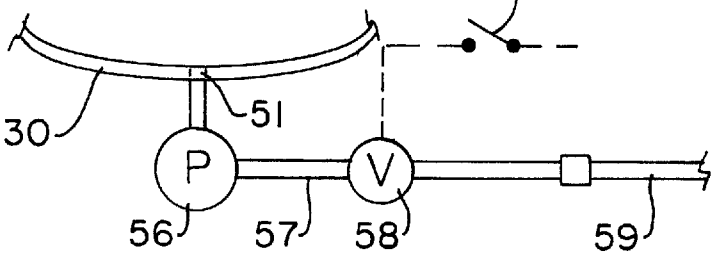
FIG. 4 is a schematic diagram of a waste water drainage system for the apparatus of this invention.

A tub 30 receives a patient for bathing. Tub 30 is of generally rectangular shape and is supported by the frame 22 of cart 20. The tub is open at the top and comprises a bottom wall 32, a pair of parallel upright sidewalls 34, a pair or generally upright end walls 36, and a rim 38 which overlies the rim 26 of cart frame 22. The end walls 36 may be rounded as shown in FIGS. 3 and 4 if desired. The rim 38 of tub 30 should be level when the tub 30 is installed in frame 22.

Tub 30 may be made of any desired material, preferably porcelain steel, although a rigid or essentially rigid molded plastic is also acceptable. The tub 30 is preferably removable from cart frame 22 simply by lifting manually, and is therefore preferably light enough in weight for convenient lifting while being shone enough to support a patient.

Water at desired temperature may be supplied to tub 30 through a water supply system, which may include hot and cold water supply lines 40 and 41, respectively, and a mixing faucet 42, which may be conventional, connected to the water supply lines. Water supply lines 40 and 41 may be formed by short lengths of polyvinyl chloride (PVC) pipe, each of which is connected (preferably by quick disconnect coupling) to a flexible water hose, which in turn can be connected to an external water source, such as hot and cold water faucets of a wash basin. Alternatively, the water supply system may utilize a single water supply pipe connected via a water hose to a water source, such as a mixing faucet of a bathtub, which can supply water at a desired temperature. The mixing faucet 42 is placed along either a side wall 34 (as shown) or an end wall 36 (either the front end wall or the rear end wall; the front end wall is preferred). An important consideration in placement of the faucet 42 and associated plumbing connections is that they must not interfere with the nylon membrane or the mechanism for raising and lowering the membrane. These parts will be described subsequently. It is desirable to provide a hand-held spray 44 connected to the mixing faucet. The hand-held spray and its connection to mixing faucet 42 may be conventional. While a water supply system is essential, it will be appreciated that details of the water supply system do not form part of the invention and can be varied.

A waste water drainage system, shown schematically in FIG. 4, drains waste water from tub 30. The water drainage system may comprise a drain opening 51 in the bottom wall 32 of the tub 30. A drain pipe 54 preferably made of PVC, receives waste water from tub 30 via opening 51 and delivers this waste water to the inlet of pump 56. A short length of rigid outlet pipe 57 (e.g. PVC) may be connected to the outlet of pump 56. A manually controlled solenoid operated valve 58 controls waste water flow through outlet pipe 57. A flexible hose 59 may be connected to the outlet end of outlet pipe 57, for delivering waste water to a location where it may discharged, such as a sink or bathtub.

A flexible membrane or sheet 60 is provided for lowering a patient into a tub 30 for bathing and for lifting the patient when bathing is completed. Membrane 60, in addition to being flexible, is preferably porous and must be strong enough to lift a patient from tub 30 with the aid of a motor driven winch (to be described subsequently) and to lower a patient gently into tub 30. It should not stretch under load (in other words, it should be dimensionally stable). Therefore it should be non-elastomeric (since rubber and other elastomers stretch under load). The membrane 60 is preferably waterproof and quick drying. Membrane 60 is thin, sheet-like, rectangular, slightly wider and somewhat longer than the interior of tub 30. Membrane 60 is longer than tub 30 so that the membrane 60 can be attached to at a first end to a rotatable shaft (to be described later) which is at a first end (usually the front end) of tub 30, and may be fixedly secured at a second end to an attaching member which is outside tub 30 at a second end (usually the back end) thereof.

The preferred membrane 60 is made of a woven cloth, which may be either plastic or metallic, although plastics are preferred because they do not feel cold to a person as a metallic cloth may. Nylon is a preferred material; other plastic (typically thermoplastic) materials which can be woven into strong cloths, e.g. polypropylene, can also be used. Since membrane 60 is woven, it is porous, permitting water in tub 30 to pass through the membrane freely as the membrane 60 is lowered into the tub 30 or raised from the tub.

A particularly preferred woven cloth, by way of example, is formed from nylon filaments, 20.5 filaments per inch in each direction (warp and weft directions) (62×62 mesh), with a filament or thread diameter of 0.0331 inch. The cloth may be reinforced. The preferred membrane 60 (for a preferred tub having a length of 5 feet and a width of 3 feet) is 12 feet long by 40 inches wide. The cloth is obtainable from McMaster-Carr of Elmhurst, Ill. as item No. 9318213. The cloth is obtainable as a web, 40 inches in width, on a shaft and is cut to length and sewn. Dimensions herein are illustrative and are not limiting; they can be changed.

The two opposite ends of membrane 60 are engaged by spaced apart first and second membrane engaging (or sheet engaging) members. These membrane engaging members together form a membrane support structure.

Figure 5:
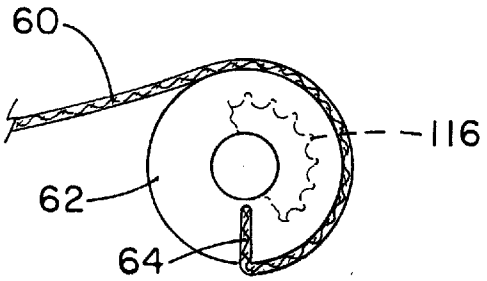
FIG. 5 is a side view of a portion of the apparatus of this invention, with parts broken away, showing one end of a flexible membrane and a driven roll which engages the flexible membrane for raising and lowering the same.

The first membrane engaging member is a driven shaft 62 having a transverse axis. Shaft 62 is higher than the rim 38 of bathtub 30. Shaft 62 is preferably made of stainless steel, is preferably solid and includes a slot 64 (see FIG. 5) for receiving the first end of membrane 60. The first end of membrane 60 may be provided with a layered and sewn insert which is received in slot 64. Slot 64 is milled in shaft 62 and extends axially (or longitudinally) the entire length of shaft 62 and radially from the center axis (or near the center axis) to the circumference of the shaft 62.

Shaft 62 is capable of rotation in opposite first and second directions. Rotation in a first direction causes the first end portion of membrane 60 to be wound around shaft 62.

Figure 2:
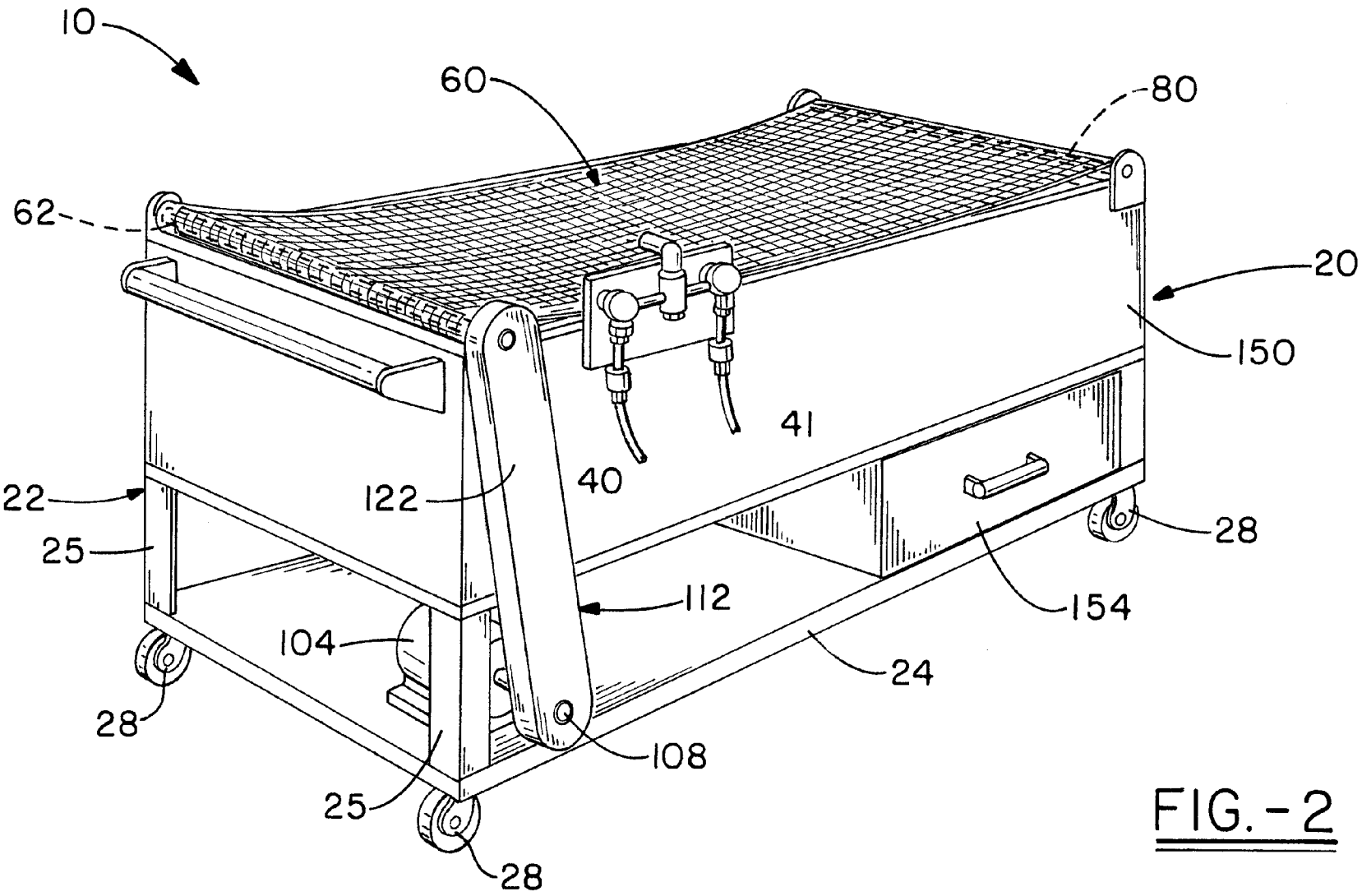
FIG. 2 is a perspective view of the apparatus of FIG. 1, as seen from the same vantage point as in FIG. 1 but with the flexible membrane extending from one end to the other end of the apparatus in a raised position.
Figure 9:
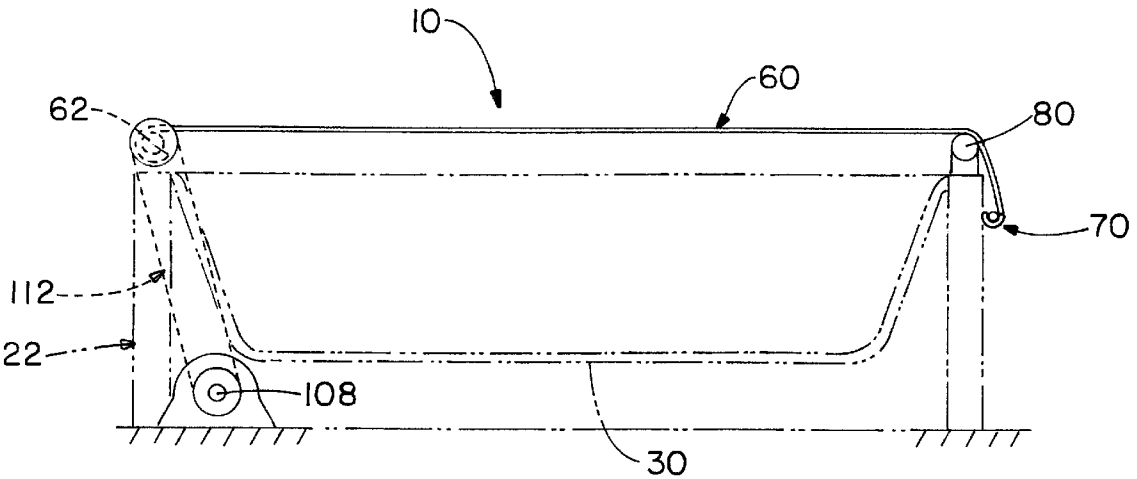
FIG. 9 is a schematic side view of the apparatus of this invention, showing the flexible membrane in a raised position.

Thereby lifting a mid-portion of membrane 60 to a raised position shown in FIGS. 2, 3 and 9. Conversely, rotation of shaft 62 in a second direction lowers the mid-portion of membrane 60 to a lowered position along the bottom wall 32 of tub 30.

Figure 6:
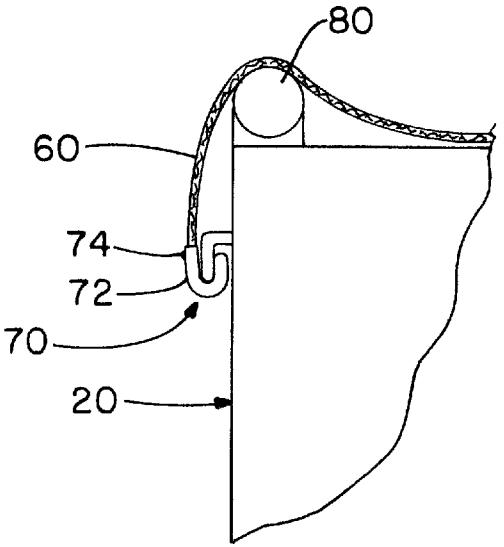
FIG. 6 is a side view of a portion of the apparatus of this invention, with parts broken away, showing a mechanism for clamping the flexible membrane at a fixed end thereof.

The second end of membrane 60 may be secured to frame 22 by means of a second membrane engaging member (or clamping assembly) 70, as shown in FIG. 6. This clamping assembly comprises a transversely extending, generally J-shaped channel 72 for receiving the second end of membrane 60, a plurality of rivets 74 which secure the membrane 60 to the channel 72, and a transversely extending angle iron 76 which forms part of frame 22. The angle iron 76, which is integrally joined to frame 22, comprises a horizontally extending web and a vertically downwardly extending web which receives the J-shaped channel or strip 72.

The lengths of channel 72 and strip member are equal to the width of frame 22, and each may be about three feet long. Galvanized steel is a preferred material for channel 72 and clamping strip 74. Channel 72 is available under the name "Unistrut" from McMaster-Carr Company, Elmhurst, Ill. A quick release pin may secure the channel 72 to the horizontal frame member 24 so that the assembly comprising channel 72, strip 74 and the attached second end of membrane 60 will not fall off.

A smooth transversely extending cylindrical bar 80 (i.e. a direction changing member) (FIGS. 3 and 6) is provided at a rearward end of apparatus 10 slightly above the level of tub rim 38 to provide for change of direction of membrane 60. Membrane 60 extends essentially horizontally and rearwardly from shaft 62 to bar 80, and then downwardly from bar 80 to membrane clamping assembly 70.

Figure 7:
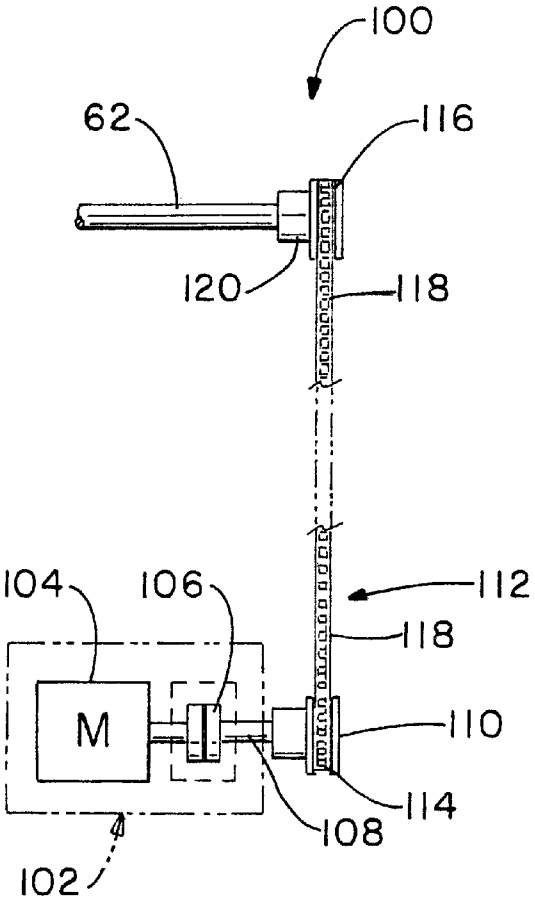
FIG. 7 is a schematic representation of a drive train for rotating a driven shaft and thereby lowering a patient into a bathtub or raising the patient out of the bathtub.

A drive mechanism 100 for driving drive shaft 62 is shown schematically in FIG. 7. Portions of this drive mechanism are also shown in FIG. 1.

Referring now to FIG. 7, drive mechanism 100 comprises a winch 102, which in turn comprises an electric motor 104 and clutch 106. Clutch 106 prevents back slippage of driven shaft 62 under load. Winch 102 may be a remote control winch. A preferred winch is obtainable from McMaster-Carr as Model W115. Winch 102 further comprises a drive shaft 108 and a pulley 110. A chain driven mechanism 112 transmits power from winch 102 to driven shaft or shaft 62. Chain driven mechanism 112 comprises a drive sprocket 114 which is concentric with drive shaft 108, a drive sprocket 116 which is concentric with driven shaft 62 and an endless drive chain 118 which extends between sprockets 114 and 116. A torque limiter 120 may also be provided. For safety, a chain guard 122 covers the chain mechanism 112.

Figure 8:
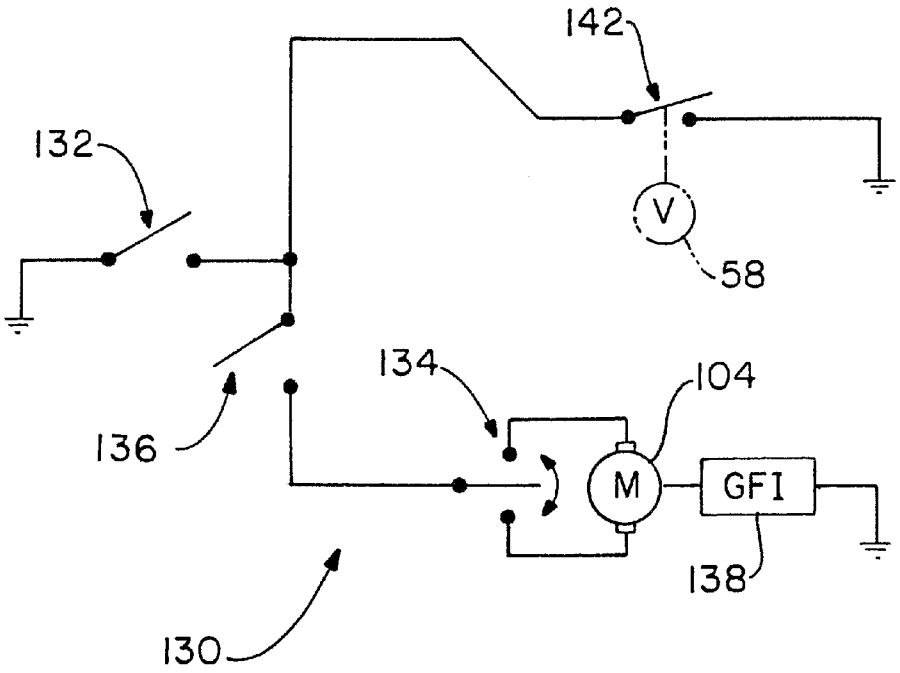
FIG. 8 is a schematic electrical diagram of the electrical system for the apparatus of this invention.

FIG. 8 shows schematically a preferred electrical system or switch mechanism for the apparatus 10. Parts of this system are also shown in other figures.

A switch mechanism 130 (FIG. 8) controls all switches and electrical circuits. Switch mechanism 130 includes an on-off switch 132, which may be a key switch, to control all power supply to apparatus 10. In series with on-off switch 132 is a winch control switch 134, which is an AC toggle switch, which controls motor 106 (FIG. 7), which in turn controls winch 102. In any case winch control switch 134 is double pole switch enabling motor 106 to rotate in either direction. Winch control switch has three positions, an on-off position, a RAISE position for raising membrane 50, and a LOWER position for lowering membrane 50. Alternately the winch control switch may be a push button switch having OFF, RAISE and LOWER buttons. For safety a longitudinally extending push bar switch 136 for quickly stopping winch 102 must also be provided on one side of apparatus 10 (FIG. 4).

A ground fault interrupter 138 is provided. Indicator lights may also be provided to show when any electrical component is in operation.

Also provided is a manually operable drain control switch 142, which may be a toggle switch to enable a user to control drainage of water from tub 30. Switch 142 is in series with on-off switch 132 (but in parallel with switch 134) and controls solenoid operated valve 58 (see also FIG. 4). In FIG. 8 GROUND is denoted by a conventional symbol.

The drive mechanism may be as simple as a hand crank which directly engages the driven shaft 62 for turning the same, but a power driven mechanism, particularly the mechanism shown, is preferred.

Panels 150 may be provided on the front, back and two sides of the apparatus 10 for esthetic reasons, as shown in FIGS. 2 and 3. The front panel 150 also provided a mounting structure for control switches. These panels 150 are vertical and made of sheet metal. The panels overlie the frame 22 and conceal the frame 22 and the interior of apparatus 10 beneath tub 30. Drawers 154 may be provided for storage operation of the apparatus and will now be described.

A foldaway transfer device 155 (shown in FIG. 3) may be provided to assist in transfer of a patient from a bed to the apparatus of this invention and vice versa. Foldaway transfer device 155 comprises a shelf which when unfolded (as shown in FIG. 3) is substantially at the height of the bathtub rim and extends outwardly therefrom along one side of the apparatus (the side opposite the water faucet 42). Foldaway device 55 may be folded downwardly against a side wall of the apparatus when not in use.

When the apparatus is not in use, electricity is off, the tub 30 is empty and the membrane 50 is in a raised position.

When it is desired to bathe a patient, the electricity is turned on by means of an on-off switch 130 and membrane 60 is maintained in a raised position as shown in FIG. 9. In this raised position, the entire membrane 60 is above rim 26 of frame 22 and rerim 38 of tub 30. The user (who may be an attendant) may move membrane actuator switch 132 to raise the position. (Even if this is not done, clutch 106 maintains the membrane 50 in the raised position.) The user also fills tub 30 with water. Desired water temperature may be achieved by manual adjustment of the flow control valves 40*a* and 41*a* in hot water line 40 and cold water line 41, respectively. The membrane 60 in its raised position is above the rim 38 of tub 30 and the level of water in tub 30.

Ideally, two attendants are used to move the patient from a bed to the apparatus of this invention and vice versa. One attendant will be at the head of the bed and the other at the foot, to slide the patient from the bed surface across transfer device 155 onto a bathing surface, i.e., raised membrane 60. Only one attendant is required for actual bathing.

Figure 10:
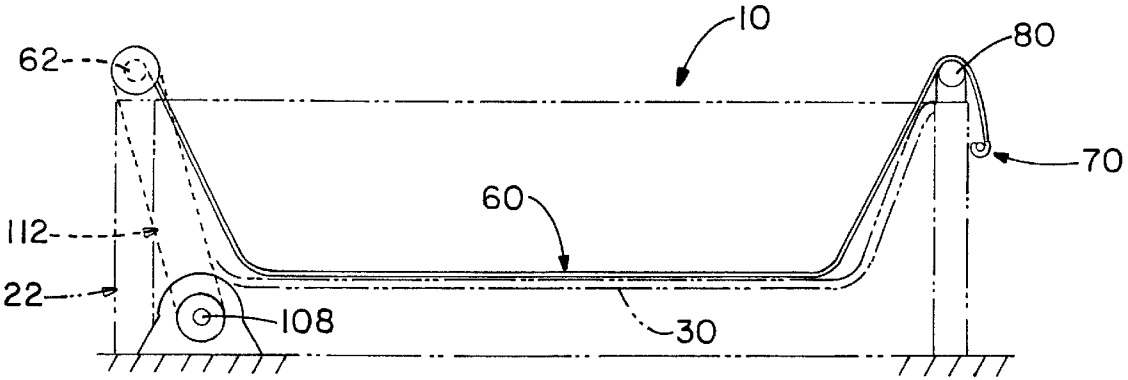
FIG. 10 is a schematic side view of the apparatus of this invention, showing the flexible membrane in a lowered position.

When the tub 30 is filled with water, the patient is lifted onto the raised membrane 60. The patient before bathing can be at a nearly convenient location, e.g. in a nearby bed or on a table (not shown) alongside one side of apparatus 10 and of a convenient height, say, the same height as that of the rim 38 or tub 30. The user then actuates the toggle switch 134 (or other desired winch control switch, such a push button switch having RAISE and LOWER buttons) to lower the membrane 60 until it touches the bottom wall 32 of tub 30 as shown in FIG. 10. In this position a mid-portion of membrane 60 is below the water level in tub 30. Opposite end portions, supported by rotatable shaft 62 and bar 80, remain above and outside tube 30 at all times. The user then bathes the patient. When the user has finished bathing the patient, the user activates the winch control switch 134 to raise the membrane 60 with the patient thereon. The user also activates the drain control switch 142 to drain water from tub 30. The user may then dry the patient and return the patient to bed.

Various modifications of the apparatus shown and described herein can be made. For example, when a free-standing bathtub (such as was well known in the early part of the twentieth century) is available, cart 20, tub 30 and elements associated with these may be omitted. The modified apparatus in that case would comprise only those elements denoted herein by reference numerals 60 through 146, e.g. membrane 60, shaft 62, a structure for affixing the second or back end of membrane 60 (which may be mounted on the floor or other suitable manner), winch 102 and the electrical controls previously described for controlling winch 102. This modified apparatus may be like that previously described except for omitted elements and will therefore not be described in detail.

Other modifications can be made without departing from the scope and spirit of the invention.

What is claimed is:

1. Apparatus for bathing a patient comprising:

(a) a portable frame being selectively movable to the location of a patient and supporting an open top tub for receiving a patient for bathing;

(b) a membrane capable of supporting a patient for lowering said patient into said tub and lifting said patient from said tub, said membrane being positioned above said tub;

(c) first and second spaced apart membrane engaging members for engaging opposite first and second ends of said membrane, said first membrane engaging member being a driven shaft which is adapted to receive said first end of said membrane, said shaft being capable of rotation in opposite first and second directions, whereby rotation of said driven shaft in said first direction causes a first end portion of said membrane to be wound around said shaft, thereby raising said membrane, and rotation of said shaft in a second direction causes said first end portion of said membrane to be unwound, thereby lowering said membrane into said tub; and (d) a drive mechanism for rotating said driven shaft, for raising and lowering of said membrane within said tub at the location of said portable frame.

2. Apparatus according to claim 1 wherein said second membrane engaging member engages said second end of said membrane and holds said second end of said membrane in a fixed position.

3. Apparatus according to claim 1 wherein said second membrane engaging member is at a lower elevation than that of said driven shaft, said apparatus further including a transversely extending direction changing member over which said membrane passes, so that said membrane extends essentially horizontally and rearwardly from said driven shaft to said direction changing member and downwardly from said direction changing member to said second membrane engaging member.

4. Apparatus according to claim 3 wherein said direction changing member is a smooth cylindrical bar.

5. Apparatus according to claim 1 wherein said membrane is of essentially rectangular configuration, having a greater length and slightly greater width than said tub.

6. Apparatus according to claim 1 wherein said membrane is constructed of a waterproof material and forms a porous membrane.

7. Apparatus according to claim 1 wherein said drive mechanism comprises an electric motor, a drive shaft driven by said motor, and an endless drive member extending between said drive shaft and said driven shaft.

8. Apparatus for lowering a patient into a bathtub and lifting a patient from said tub said apparatus comprising;

(a) a membrane capable of supporting a patient for lowering said patient into said tub and lifting said patient from said tub, said tub having a longitudinal axis, and said membrane being adapted to be positioned above said tub along said longitudinal axis;

(b) first and second spaced apart membrane engaging members positioned at opposed ends of said tub and being substantially perpendicular to said longitudinal axis for engaging opposite first and second ends of said membrane, said first membrane engaging member being a driven shaft which is adapted to receive said first end of said membrane, said shaft being capable of rotation in opposite first and second directions, whereby rotation of said driven shaft in said first direction causes a first end portion of said membrane to be wound around said shaft, thereby raising said membrane, and rotation of said shaft in a second direction causes said first end portion of said membrane to be unwound, thereby lowering said membrane into said tub; and (c) a drive mechanism for rotating said driven shaft, for raising and lowering of said membrane.

9. The apparatus according to claim 1, wherein said frame is mounted on wheels for transporting said frame to said location, and including at least one wheel locking mechanism to fix said frame in said location.

10. The apparatus according to claim 1, wherein said tub further includes a water supply system selectively coupled to a source of water.

11. The apparatus according to claim 10, wherein said water supply system includes a hot and cold water supply and valving to allow selective introduction of hot or cold water into said tub.

12. The apparatus according to claim 10, wherein said water supply system includes a hand-held spray nozzle to selectively supply water to a desired location.

13. The apparatus according to claim 1, further comprising a transfer device associated with said frame for selectively positioning a patient for transfer onto said membrane.

14. The apparatus according to claim 7, further comprising a electrical power supply circuit for selective operation of said motor and a ground fault interrupter associated therewith.

15. A method for bathing a disabled patient which comprises:

(a) providing a portable bathing apparatus which comprises (1) a portable frame being selectively positionable at a predetermined location relative to a patient, said frame carrying an open top tub for receiving a patient for bathing; (2) a membrane capable of supporting a patient for lowering said patient into said tub and lifting said patient from said tub, said membrane being positioned above said tub; (3) first and second spaced apart membrane engaging members for engaging opposite first and second ends of said membrane said first membrane engaging member being a rotatable shaft which is adapted to receive said first end of said membrane, said shaft being capable of rotation in opposite first and second directions;

(b) filling said tub with water to a desired water level;

(c) placing said patient on said membrane while said membrane is in a raised position above said water level;

(d) causing rotation of said rotatable shaft to lower said membrane and said patient thereon into said tub;

(e) bathing said patient; and (f) causing rotation of said rotatable shaft to raise said membrane and said patient thereon to a raised position when bathing is finished.

* * * * *